US006810543B2

(12) United States Patent
Fuhriman

(10) Patent No.: US 6,810,543 B2
(45) Date of Patent: Nov. 2, 2004

(54) ORTHOPEDIC BODY SEGMENT SUPPORT

(76) Inventor: Richard Apollo Fuhriman, 13910 SE. 23 St., Bellevue, WA (US) 98005

( * ) Notice: Subject to any disclaimer, the term of this patent is extended or adjusted under 35 U.S.C. 154(b) by 0 days.

(21) Appl. No.: 10/178,037

(22) Filed: Sep. 9, 2002

(65) Prior Publication Data

US 2003/0014818 A1 Jan. 23, 2003

Related U.S. Application Data

(60) Provisional application No. 60/306,526, filed on Jul. 20, 2001.

(51) Int. Cl.[7] ..... A47C 27/00; A61F 5/00

(52) U.S. Cl. ..... 5/632; 5/731

(58) Field of Search ..... 5/632, 630, 731

(56) References Cited

U.S. PATENT DOCUMENTS 4,665,573 A * 5/1987 Fiore ..... 5/731
4,688,283 A * 8/1987 Jacobson et al. ..... 5/731 X
4,972,535 A * 11/1990 Goldman ..... 5/731
5,279,310 A * 1/1994 Hsien ..... 5/632
5,742,963 A * 4/1998 Trevino et al. ..... 5/632
5,774,916 A * 7/1998 Kurhi ..... 5/632
6,067,678 A * 5/2000 Trevino ..... 5/731 X
2003/0014818 A1 * 1/2003 Fuhriman ..... 5/632

* cited by examiner

*Primary Examiner*—Robert G. Santos
(74) *Attorney, Agent, or Firm*—Fehr Law Firm; Thompson E. Fehr

(57) ABSTRACT

A pillow (or several pillows depending upon need/size configuration) having unique shapes for placing between an individual's back, head, backside, legs, arms (or any combination thereof) and the floor, ground, bed, table or other surface to provide anatomical support as opposed to simply providing cushioning between the body on the underlying surface. When the individual is lying on his or her back, the pillow provides for proper alignment of the body to relieve pressure on joints, nerves, muscles and skin. Its unique posturing permits the body to relax and rest more comfortably and also potentially increase blood flow and nerve transmission throughout the body or through specific areas of the body. It is beneficial to those who suffer from a variety of shoulder, neck, back, hip, and other problems, arthritis and sports related injuries and fatigue in addition to those who are convalescent, bedridden, computer operators (or other jobs with periodic sitting), overhead throwers, data entry personnel and anyone who uses their shoulder, back, neck, hips and arms for an extended period of time.

10 Claims, 7 Drawing Sheets

ORTHOPEDIC BODY SEGMENT SUPPORT

CROSS-REFERENCE TO REALTED APPLICATIONS

Figure 1:
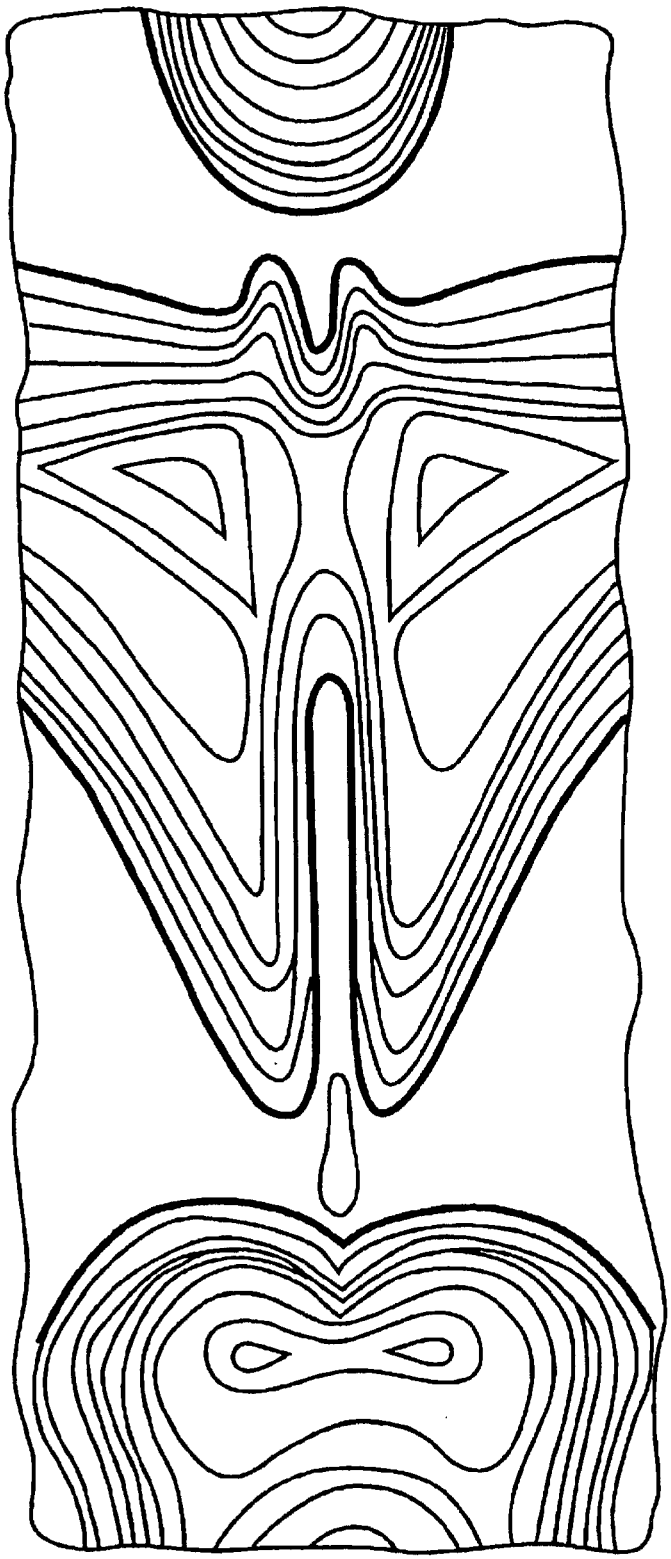

This is a continuation of copending U.S. provisional application Ser. No. 60/306,526, filed on Jun. 20, 2001.

BACKGROUND OF THE INVENTION

1. Field of the Invention

This invention relates to a pillow used for therapeutic purposes and, more particularly to a pillow that is placed under the body of an individual lying supine to provide support with the intention of maintaining the individual's body in proper alignment.

2. Description of the Prior Art

Previous attempts have been made and patented in regard to devices and, in particular, to pillows used to provide support and align various parts of an individual's body. Generally, prior patents disclose pillows which are of such type that they are utilized all along the body of the user without the specific support at each area of the body that this concept provides with the concave impressions specifically made to fit between the base of the head and the lower extremities of the user.

Examples of prior patents are as follows: U.S. Pat. No. 2,056,767 issued on Oct. 15, 1935 to William H. Blath discloses a back pad attachable to the body of a user so that it will be held in position whether the patient is lying in bed of sitting, and which will permit freedom of movement for the spinal column in either position of the wearer.

U.S. Pat. No. 2,522,120 issued on Sep. 12, 1950 to Louis and Mary Kaskey discloses a pillow used to support the head while in a train or automobile.

U.S. Pat. No. 4,007,503 issued to Bernard Watkin on Feb. 15, 1977 discloses a pillow to place under the head and neck while sleeping.

U.S. Pat. No. 6,185,768 issued to Amanda Schlechter on Feb. 13, 2001 discloses a cushion where a woman lies prone. This device is only designed for female patients lying prone. It provides no contours, but does eliminate any pressure on the breast portion of a woman due to a complete lack of foam in that area.

U.S. Pat. No. 3,795,018 issued on Mar. 5, 1974 to Charley H. Broaded discloses an adjustable bed having a surface with supports of varying heights whereby the head, shoulders and legs are propped.

U.S. Pat. No. 4,173,048 issued on Nov. 6, 1979 to John A. Varaney discloses a pillow configuration having a central head supporting portion forming the top of the pillow and two extension portions positioned substantially perpendicularly to the central portion and extending substantially vertically downwardly therefrom, thus resulting in a pillow construction which provides sleeping comfort for the head and shoulders of the user.

U.S. Pat. No. 4,584,730 issued on Apr. 29, 1986 to Eva Rajan discloses a device for stabilizing the pelvis by supporting the lumbar region of an individual. Additional attachments support the individual's hipbones.

U.S. Pat. No. 4,624,021 issued on Nov. 25, 1986 to Jean A. Hofstetter discloses a cushion-like support with a neck extending from the shoulder area to the pelvis to bolster the torso of the user, thereby allowing the pressure points in the lower extremities of the user to be relieved.

U.S. Pat. No. 4,754,510 issued on Jul. 5, 1988 to Harry A. King discloses a body pillow for enhancing sleep or rest which is constructed and arranged to cushion and encapsulate the entire length of the body while providing a comfortable cushioned separation of the arms and legs of the user.

None of these patents, either taken singly or in combination, disclose the unique construction of the instant invention.

SUMMARY OF THE INVENTION

Accordingly, it is an object, advantage, and feature of the invention to provide a pillow, having distinct concave and convex impressions mimicking the reverse of the head, and/or torso, and/or buttocks and/or legs of an individual to provide total support in a three-dimensional scope, not just a planar support as is found with a typical mattress or cushion.

It is another object, advantage, and feature of the invention to provide increased blood flow throughout the entire body decreasing the possibility of bed sores and other deleterious effects of ischemia and pressure to regions of the body including the head, shoulders, neck, thoracic, lumbar, sacral, gluteal, thighs, calves, feet, arms and hands.

It is another object, advantage, and feature of the invention to provide a suspensory feeling to the body caused by the device's ability to distribute the weight and pressure in all areas of the body, spread out over the entire region instead of specific pressure points.

It is another object, advantage, and feature of the invention to provide stress relief and relaxation akin to taking an extensive nap or sleep in a relatively short (15–30 minute) time frame.

It is another object, advantage, and feature of the invention to provide relief to the bed-ridden and others who must spend a large part of their day in a supine position to assist in repositioning the joints, distributing stress and pressure, alleviating excess ischemia to pressure points by redistributing the suffocating pressure by spreading it out over a larger portion of the body region.

It is another object, advantage, and feature of the invention to provide this support in any number of combinations. It could be accomplished as one, solid device, two (or more) pillows/cushions that could fold away for storage or easy transportation and parts of the support structure (just the head/neck portion, just the lumbar region or just the leg portion or combinations thereof) could be used with or without the other portions.

It is another object, advantage, and feature of the invention to provide a stretching to the spine while placing the body in an "open-packed" position. This is accomplished by the positioning of the body segments into a joint-neutral position (positional release therapy, I call it) permitting the antagonistic muscles to relax thereby permitting increased blood flow, nerve conduction and general joint relaxation to the region. As this occurs 'upstream' (for instance, the shoulder is upstream of the hand and forearm), this will have an overall increase of relaxation, blood flow, and nerve conduction resulting in reduction in repetitive stress disorder-type injuries in the extremities, an increase in the ability (intensity and duration) of work and play and a decrease in pain and discomfort. This is a benefit to computer operators, video game enthusiasts, machine operators, laborers, artisans, crafts-workers, athletes, yoga practitioners, office workers, travelers and others.

It is another object, advantage, and feature of the invention to provide a stretch to the spine by supporting specifically the spine in a neutral position relieving the supporting, intrinsic musculature of its need to protect the spine for a few minutes. This permits these muscles to relax for possibly the only time of the day, rejuvenating them and providing them the opportunity to heal from any damage caused by poor posture.

It is another object, advantage, and feature of the invention to provide athletes and others (including military personnel) the ability to reposition their spine post-exercise or post-trauma into a joint-neutral position. This accelerates post-exercise/trauma recovery time and enhances the ability to participate in the activity much sooner than normal.

It is another object, advantage, and feature of the invention to provide a slight posterior tilt of the cervical/head region increasing the stretch on the cervical spine and relieving these specific muscles of the weight of the head. This increases the feeling of relaxation to the whole body by also assisting (by postural placement) the user to breath more easily.

It is another object, advantage, and feature of the invention to provide a stretching of the torso and rib cage that facilitates the ease of use of the lungs. This also helps in permitting the heart and lungs to operate with less pressure from a tightened rib cage, decreasing the force needed for them to function fully.

It is another object, advantage, and feature of the invention to provide assistance to those experiencing degenerative disc problems, muscle tears, strains and injuries, arthritis, stress and tension headaches and bedsores. Also for those needing post-surgery recovery, pre-surgery prevention, pre-exercise relaxation and visualization, post-exercise recovery and relaxation, naps, general sleep (pre-sleep routine and relaxation permitting a deep sleep), stress/tension relief, shoulder, back, neck and other stress release.

It is another object, advantage, and feature of the invention to provide support to many different individuals with the several sizes of the device, and if desired, can be exactly fitted to the exact specifications of an individual's own body dimensions. This is not necessary in most instances due to the similar size of the spine (skull to sacrum) region on most individuals.

It is another object, advantage, and feature of the invention to provide portability by creating the device in sizes small enough to fit in a carry-on piece of luggage (or smaller) and large enough to fit over the largest bed, depending upon the needs of the individual user.

These, and other object, advantages, and features of the invention determination will become apparent from the following description, drawings and claims.

DETAILED DESCRIPTION OF THE SEVERAL VIEWS OF THE DRAWING

Throughout the several drawings, A-1 supports the head portion, B-2 supports the deepest portion of the upper torso, (approximately at the point of the spine of the scapula), C-3 supports the approximate mid-point of the thoracic spine (the midpoint between the cervical and lumbar spine), D-4 supports the neck region, F-5 supports the lumbar musculature portion of the torso, G-6 supports the anterior superior iliac spine (hip) and the lower lumbar region, H-7 supports the gluteals (and is near the deepest portion of the device) I-8 is where the right, posterior thigh is supported, L-11 or N-13 is the point where the upper leg enters the leg portion and M-12 is the point where the foot/ankle is supported.

FIG. 1 shows an overhead view of the head/back/gluteal portion of the device with contour lines demonstrating dimension (that will be more fully explained with the consequent drawings).

Figure 2:
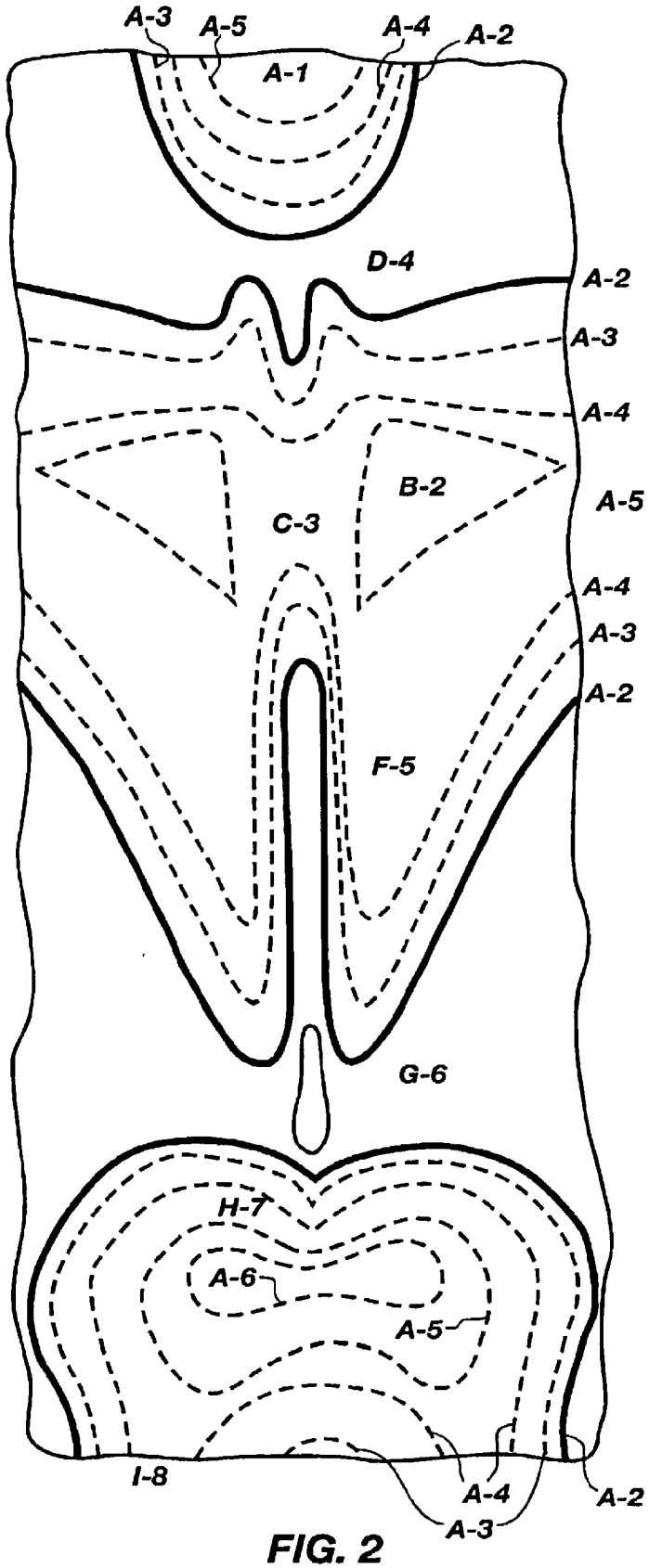

FIG. 2 again shows an overhead view of the head/back/gluteal portion of the device with contour lines demonstrating dimension with line A-2 being the top layer, A-3 at a lower depth than A-2, A-4 at a lower depth than A-3, A-5 at a lower depth than A-4 and A-6 at a lower depth than A-5. These depth changes are gradual between the lines when the manufacturing permits smooth transitions. The impressions in the cushion mimic the approximate depth and width of the upper torso and midsection of the individual for whom the device is designed (small person or large person and everyone in-between).

Figure 3:
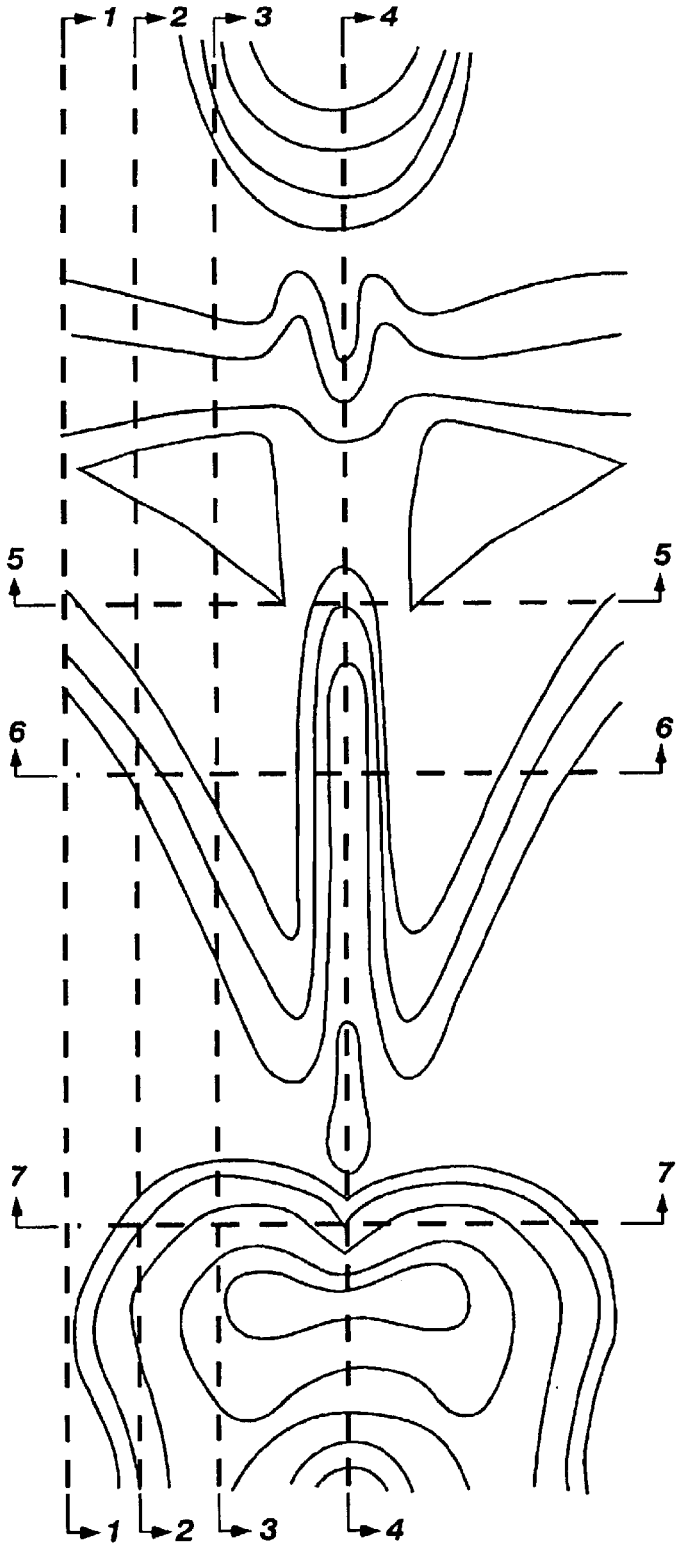

FIG. 3 is a guide for FIGS. 4 and 5. FIG. 3 demonstrates the reference areas for the cross-cut sections that are provided to help clarify the contours of the device.

Figure 4A:
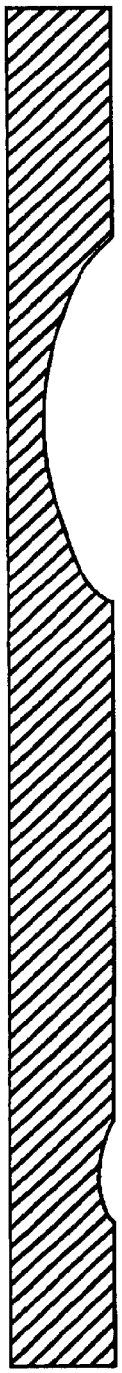
Figure 4B:
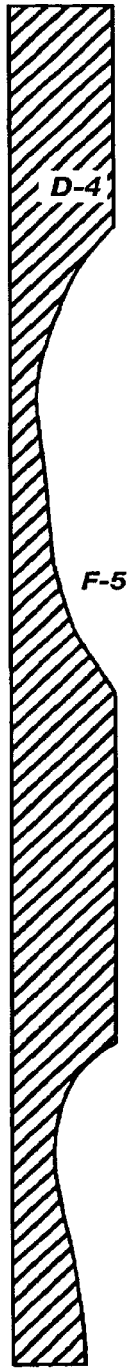
Figure 4C:
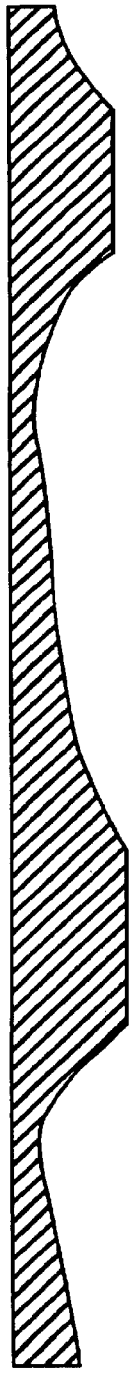
Figure 4D:
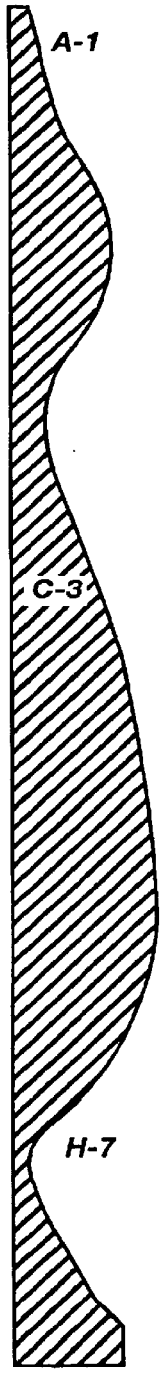

FIG. 4*a* shows the sagittal cross section looking in the direction of arrows 1—1 in FIG. 3, FIG. 4*b* shows the sagittal cross section looking in the direction of arrows 2—2 in FIG. 3, FIG. 4*c* shows the sagittal cross section looking in the direction of arrows 3—3 in FIG. 3, and FIG. 4*d* shows the sagittal cross section looking in the direction of arrows 4—4 in FIG. 4.

Figure 5A:
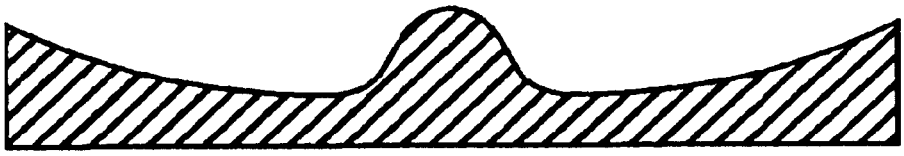
Figure 5B:
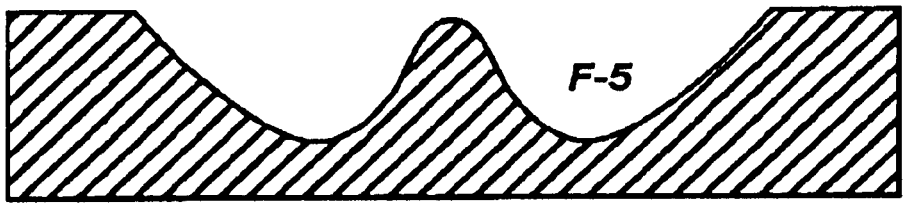
Figure 5C:
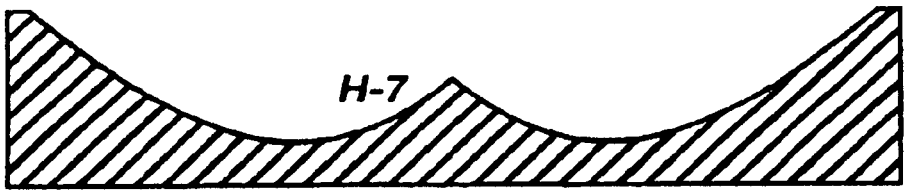

FIG. 5*a* shows the transverse cross sections looking in the direction of arrows 5—5 in FIG. 3, FIG. 5*b* shows the transverse cross section looking in the direction of arrows 6—6 in FIG. 3, and FIG. 5*c* shows the transverse cross section looking in the direction of arrows 7—7 in FIG. 3 to demonstrate the specific contours of the device.

Figure 6:
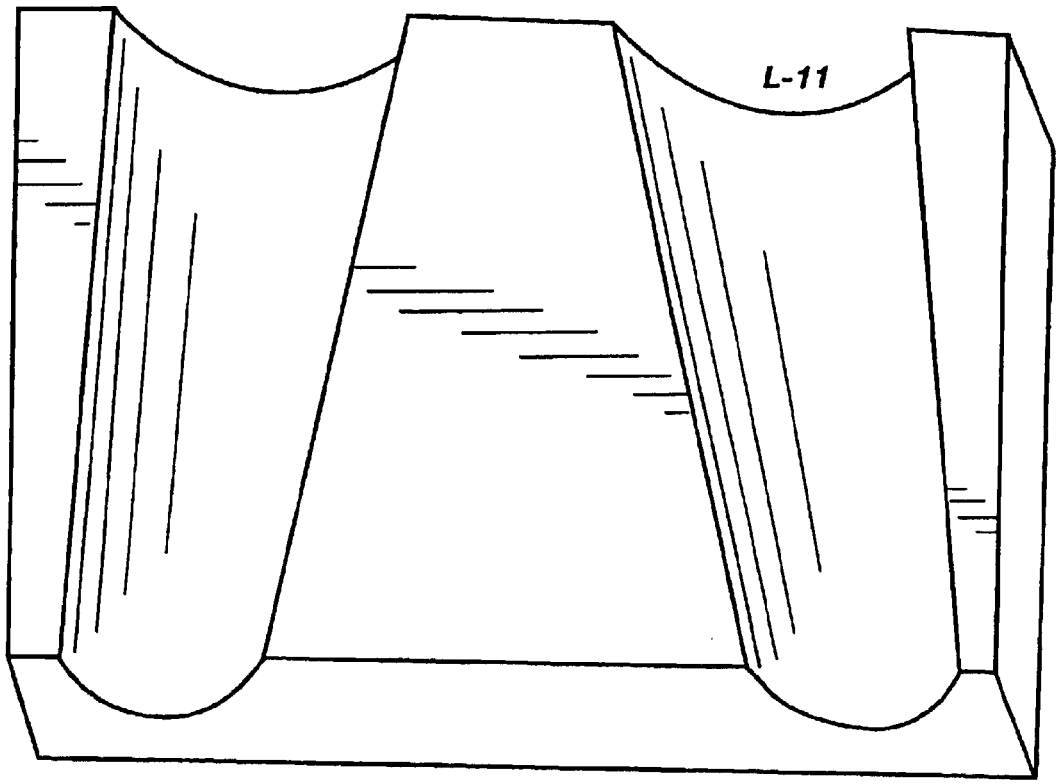

FIG. 6 provides a description of a leg portion that is designed to support only part of the legs, knees or thighs. It is not a full-leg design as FIG. 7 is.

Figure 7:
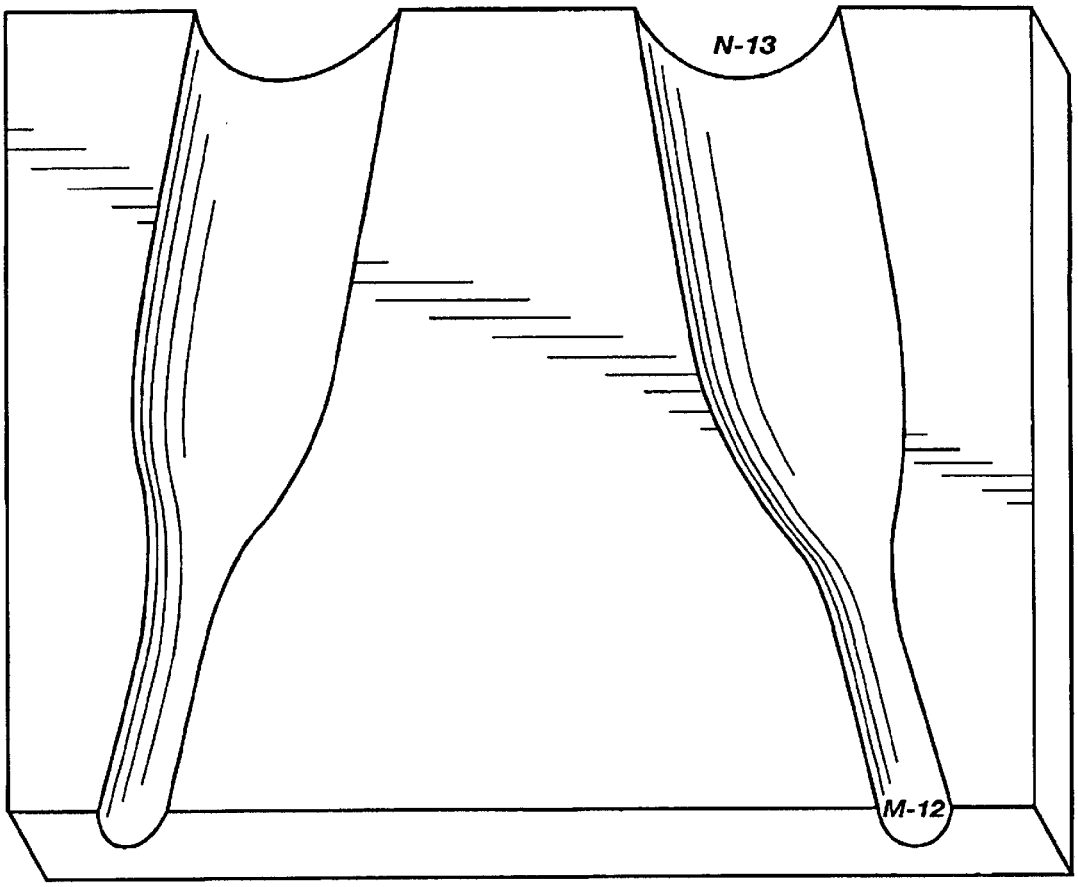

FIG. 7 shows the full-leg separation providing for support of the leg. This also shows the angle of the leg separation, being crucial for the support of the lower region. The impressions in the cushion mimic the approximate depth and width of the legs of the individual for whom the device is designed (small person or large person and everyone in-between).

As used herein, the term "impression" is synonymous with the word "surface". Thus, a convex impression means a projection while a concave impression means a depression, as is evident from the accompanying figures.

What is claimed is:

1. An orthopedic body segment support, which comprises:

a cushion shaped with distinct concave and convex surfaces that mimic the reverse of a body segment about a given joint and cause the antagonistic muscles of a user around the given joint to relax.

2. The orthopedic body segment support as recited in claim 1, wherein:

the concave and convex surfaces are shaped to mimic a body segment of a specific user.

3. The orthopedic body segment support as recited in claim 1, wherein:

the body segment the reverse of which the cushion mimics is a head and cervical spine and relaxation of antagonistic muscles of a user about the cervical spine is accomplished by having such a shape to the cushion as creates a posterior tilt to the head of the user.

4. The orthopedic body segment support as recited in claim 3, wherein:

the head and cervical spine the reverse of which is mimicked is the head and cervical spine of a specific user.

5. The orthopedic body segment support as recited in claim 1, wherein:

the body segment the reverse of which the cushion mimics is a torso and rib cage and relaxation of antagonistic muscles of a user about the torso and rib cage is accomplished by having such a shape to the cushion as stretches the torso and rib cage.

6. The orthopedic body segment support as recited in claim 5, wherein:

the torso and rib cage the reverse of which is mimicked is the torso and rib cage of a specific user.

7. The orthopedic body segment support as recited in claim 1, wherein:

the body segment the reverse of which the cushion mimics is buttocks and upper legs and relaxation of the antagonistic muscles of a user about the buttocks and upper legs is accomplished by having the legs spread apart, rather than being parallel to one another.

8. The orthopedic body segment support as recited in claim 7, wherein:

the buttocks and upper legs the reverse of which are mimicked are the buttocks and legs of a specific user.

9. An orthopedic body segment support, which comprises:

a cushion shaped with distinct concave and convex surfaces that mimic the reverse of a head and cervical spine and relaxation of antagonistic muscles of a user about the cervical spine is accomplished by having such a shape to the cushion as creates a posterior tilt to the head of the user, distinct concave and convex surfaces that mimic the reverse of a torso and rib cage and relaxation of antagonistic muscles of a user about the torso and rib cage is accomplished by having such a shape to the cushion as stretches the torso and rib cage, and distinct concave and convex surfaces that mimic the reverse of buttocks and upper legs and relaxation of the antagonistic muscles of a user about the buttocks and upper legs is accomplished by having the legs spread apart, rather than being parallel to one another.

10. The orthopedic body segment support as recited in claim 9, wherein:

the head and cervical spine, the torso and rib cage, and the buttocks and upper legs the reverse of which are mimicked are the head and cervical spine, the torso and rib cage, and the buttocks and upper legs of a specific user.

* * * * *